US007371058B2

(12) United States Patent
Jung et al.

(10) Patent No.: US 7,371,058 B2
(45) Date of Patent: May 13, 2008

(54) OIL FEEDING PROPELLER OF SCROLL COMPRESSOR

(75) Inventors: Chul-su Jung, Seoul (KR); Byung-kil Yoo, Seoul (KR); Byeong-chul Lee, Seoul (KR); Hong-hee Park, Seoul (KR); Se-heon Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/213,224

(22) Filed: Aug. 26, 2005

(65) Prior Publication Data

US 2006/0222551 A1 Oct. 5, 2006

(30) Foreign Application Priority Data

Mar. 30, 2005 (KR) ..... 10-2005-0026593
Mar. 30, 2005 (KR) ..... 10-2005-0026596

(51) Int. Cl.
*F04C 18/04* (2006.01)
*F04C 29/02* (2006.01)

(52) U.S. Cl. ..... 418/88; 418/55.6; 418/55.1; 184/6.18; 184/6.16; 184/6.23

(58) Field of Classification Search ..... 418/88, 418/55.6, 55.1; 184/6.18, 6.16, 6.23
See application file for complete search history.

(56) References Cited

U.S. PATENT DOCUMENTS 3,410,478 A * 11/1968 Geisenhaver ..... 417/366
3,563,677 A * 2/1971 Retan ..... 417/415
3,988,080 A * 10/1976 Takada ..... 418/76
4,097,185 A * 6/1978 Wolf ..... 415/88
4,209,080 A * 6/1980 Douglas ..... 184/6.16
4,421,453 A * 12/1983 Hoff et al. ..... 415/88
4,553,857 A * 11/1985 Ney ..... 384/398
4,702,683 A * 10/1987 Inaba et al. ..... 418/55.6
4,750,864 A * 6/1988 Bayyouk et al. ..... 416/203
5,017,108 A * 5/1991 Murayama et al. ..... 418/55.6
5,176,506 A * 1/1993 Siebel ..... 417/368
5,720,602 A * 2/1998 Hill et al. ..... 418/55.4
5,803,718 A * 9/1998 Woo ..... 417/372
5,842,420 A * 12/1998 Khoo et al. ..... 184/6.16
6,139,295 A * 10/2000 Utter et al. ..... 418/55.6
2006/0045784 A1* 3/2006 Grassbaugh ..... 418/55.6

FOREIGN PATENT DOCUMENTS

JP 57181987 A * 11/1982
JP 57181988 A * 11/1982
JP 01036994 A * 2/1989
JP 02-086971 3/1990
JP 03267594 A * 11/1991

* cited by examiner

*Primary Examiner*—Thomas Denion
*Assistant Examiner*—Mary A Davis
(74) *Attorney, Agent, or Firm*—Lee, Hong, Degerman, Kang & Schmadeka

(57) ABSTRACT

An oil feeding propeller of a scroll compressor for preventing deterioration of oil feeding generated when a rotation shaft is rotated in reverse is disclosed. The propeller is tightly fitted into the lower side of the oil passage of the rotation shaft, sucks oil into the shell due to rotation shaft of shaft to raise oil to a compression part of the scroll compressor. The propeller includes a plate without operative direction for feeding oil in a predetermined direction so as to raise a predetermined quantity of oil regardless of the rotation direction shaft.

9 Claims, 10 Drawing Sheets

OIL FEEDING PROPELLER OF SCROLL COMPRESSOR

CROSS REFERENCE TO RELATED APPLICATIONS

Pursuant to 35 U.S.C. § 119(a), this application claims the benefit of earlier filing date and right of priority to Korean Patent Application No. 10-2005-0026593 and 10-2005-0026596, filed on Mar. 30, 2005, the content of which is hereby incorporated by reference herein in its entirety.

BACKGROUND OF THE INVENTION

1. Field of the Invention

The present invention relates to a scroll compressor, and more particularly, to an oil feeding propeller of a scroll compressor for preventing deterioration of the oil feed performance generated when a rotation shaft is rotated in reverse.

2. Description of the Related Art

Generally, a scroll compressor is a high-efficiency-and-low-noise compressor widely employed in the air conditioning field. In the scroll compressor, a plurality of compression chambers formed between two scrolls when the scrolls are rotated and the compression chambers move toward the centers of the scrolls so that volumes of the compression chambers are decreased and the scrolls are spaced apart from each other again and refrigerant gas is sucked into the scroll compressor.

FIG. 1 is a vertical sectional view illustrating a conventional scroll compressor.

As shown in the drawing, the conventional scroll compressor includes a rotation shaft 400 rotatably supported in a shell 100 by a main frame 200 and a sub-frame 300 and having an oil passage 401 formed in the axial direction, a compression part 500 installed at the upper sides of the main frame 200 and having an orbiting scroll 501 coupled with the rotation shaft 400 and a non-orbiting scroll 502 coupled with the orbiting scroll 501, a driving part 600 for driving the rotation shaft 400, and an oil feeding propeller 700 tightly fitted into the lower end of the oil passage 401 and serving to feed oil reserved in the shell 100 to the compression part 500 through the oil passage 401.

In the scroll compressor, when the rotation shaft 400 is rotated by the driving part 600, the orbiting scroll 501 is orbited, and refrigerant gas is sucked into a space between the orbiting scroll 501 and the non-orbiting scroll 502 coupled with the orbiting scroll 501 so that the refrigerant gas is compressed due to the orbiting operation of the orbiting scroll 501 and is discharged out of the scroll compressor.

At that time, oil reserved in the lower side of the shell 100 ascends along the oil passage 401 due to the rotation of the oil feeding propeller 700 rotated together with the rotation shaft 400 and is fed toward the inner surface of the orbiting scroll 501 orbiting while being coupled with the non-orbiting scroll 502. Therefore, paces where the orbiting scroll 501 is coupled with the non-orbiting scroll 502 are sealed and slide.

FIG. 2 is an enlarged view of main parts of the conventional scroll compressor in FIG. 1, and FIG. 3 is a perspective view of an oil feeding propeller of the conventional scroll compressor depicted in FIG. 2.

As shown in the drawings, the oil feeding propeller 700 tightly fitted into the oil passage 401 formed in the lower side of the rotation shaft 400 includes a plate coupling part 701 and bending parts 702 connected to the lower side of the coupling part 701 and bent in opposite directions so as to feed oil in a predetermined direction.

The oil feeding propeller 700 is rotated together with the rotation shaft 400 in the oil passage 401 and raises oil in the oil passage 401 to the bending parts when the rotation shaft 400 is rotated.

Thus, the bending parts 702 have a directional structure for feeding oil in the predetermined direction so that the bending parts 702 are rotated together with the rotation shaft 400 to raise oil.

However, the oil feeding propeller of the conventional scroll compressor has the following shortcomings.

Since the oil feeding propeller of the conventional scroll compressor is formed to have the directional structure for feeding oil in the predetermined direction, i.e. upwards, oil is fed in the reverse direction, i.e. downwards, when the rotation shaft is rotated in reverse due to improper connection or wrong installation of power supply of the driving part and operational malfunction. Thus, the oil feeding propeller cannot raise oil normally and causes the counter result of lowering oil already fed to the compression part.

Moreover, since oil cannot be fed sufficiently to the compression part when the rotation shaft is rotated in reverse, the compression part is damaged and reliability of the conventional scroll compressor is remarkably deteriorated.

SUMMARY OF THE INVENTION

Therefore, the present invention has been made in view of the above and/or other problems, and it is an object of the present invention to provide an oil feeding propeller of a scroll compressor for preventing deterioration of oil feeding performance generated when a rotation shaft is rotated in reverse.

It is another object of the present invention to provide an oil feeding propeller of a scroll compressor for reducing flow resistance of oil generated when the oil feeding propeller is rotated at high speed and for reducing the quantity of oil to be fed.

It is yet another object of the present invention to provide an oil feeding propeller of a scroll compressor for reducing flow resistance of oil and for smoothly raising oil.

It is yet another object of the present invention to provide an oil feeding propeller of a scroll compressor that is easily assembled and coupled.

In accordance with the present invention, the above and other objects can be accomplished by the provision of an oil feeding propeller of a scroll compressor including an oil passage formed in a rotation shaft of the scroll compressor in the axial direction, and a plate tightly fitted in the lower side of the oil passage and rotated to raise a predetermined quantity of oil to a compression part of the scroll compressor via the oil passage regardless of rotational direction of the rotation shaft.

Preferably, the oil feeding propeller of a scroll compressor further includes an oil reducer for reducing flow resistance of oil and for reducing quantity of oil to be fed to the compression part.

The oil reducer includes an upper groove formed in the upper side of the plate, and a lower groove formed in the lower side of the plate corresponding to the upper groove.

Preferably, the oil reducer includes at least one longitudinal hole formed in the plate in the longitudinal direction.

The oil reducer includes at least one lateral hole formed in the plate in the lateral direction.

The oil reducer may include an upper groove formed in the upper side of the plate, a lower groove formed in the lower side of the plate corresponding to the upper groove, and a center hole formed between the upper groove and the lower groove.

The oil feeding propeller of a scroll compressor further includes an elastic support for elastically forcing the plate into close contact with the oil passage.

Preferably, the elastic support includes blades formed at the lateral sides of the plate and elastically and closely contacting the inner wall of the oil passage.

The blades are symmetrically formed to each other to elastically and closely contact the inner wall of the oil passage, and have an arc shape.

In accordance with the present invention, the above and other objects can be accomplished by the provision of an oil feeding propeller of a scroll compressor including an oil passage formed in a rotation shaft of the scroll compressor in the axial direction, a plate tightly fitted into the lower side of the rotation shaft and rotated together with the rotation shaft to raise a predetermined quantity of oil to a compression part of the scroll compressor via the oil passage regardless of rotational direction of the rotation shaft, and an inclined member integrally formed with the plate at an angle to reduce flow resistance of oil contacting the plate and to raise oil to the compression part.

Preferably, the inclined member includes an upper inclined plate cut off from the upper side of the plate and upwardly inclined at an angle, and a lower inclined plate cut off from the lower side of the plate and downwardly inclined at the same angle as the angle of the upper inclined plate.

The inclined member may include an upper inclined plate, cut off from the central portion of the plate, downwardly inclined at an angle, and connected to the upper side of the plate, and a lower inclined plate, cut off from the central portion of the plate, and upwardly inclined at the same angle as the angle of the upper inclined plate in parallel relation to the upper inclined plate, and connected to the lower side of the plate.

The inclined member may include an upper inclined plate cut off from the central upper portion of the plate in the longitudinal direction and upwardly inclined at an angle, and a lower inclined plate cut off from the central lower portion of the plate in the longitudinal direction and downwardly inclined at the same angle as the angle of the upper inclined plate.

The inclined member may include an upper inclined plate bent at the upper side of the plate and upwardly inclined at an angle, and a lower inclined plate bent at the lower side of the plate in the direction opposite to the direction of the upper inclined plate and downwardly inclined at the same angle as the angle of the upper inclined plate.

The inclined member may include a plurality of inclined plates cut off from the intermediate portion of the plate at regular intervals and inclined at an angle.

The inclined member may include an upper inclined plate cut off from the upper lateral sides of the plate and upwardly inclined at an angle, and a lower inclined plate cut off from the lower lateral sides of the plate and inclined at an angle.

The inclined member may include a plurality of inclined plates cut of from several places of the lateral sides of the plate in the longitudinal direction, upwardly inclined at an angle, and having upper sides thereof connected to the plate.

BRIEF DESCRIPTION OF THE DRAWINGS

The object and advantages of the present invention will become apparent and more readily appreciated from the following description of an embodiment, taken in conjunction with the accompanying drawings, in which.

DESCRIPTION OF THE PREFERRED EMBODIMENTS

Hereinafter, an oil feeding propeller of a scroll compressor according to the preferred embodiments of the present invention will be described in detail with reference to the accompanying drawings.

Figure 1:
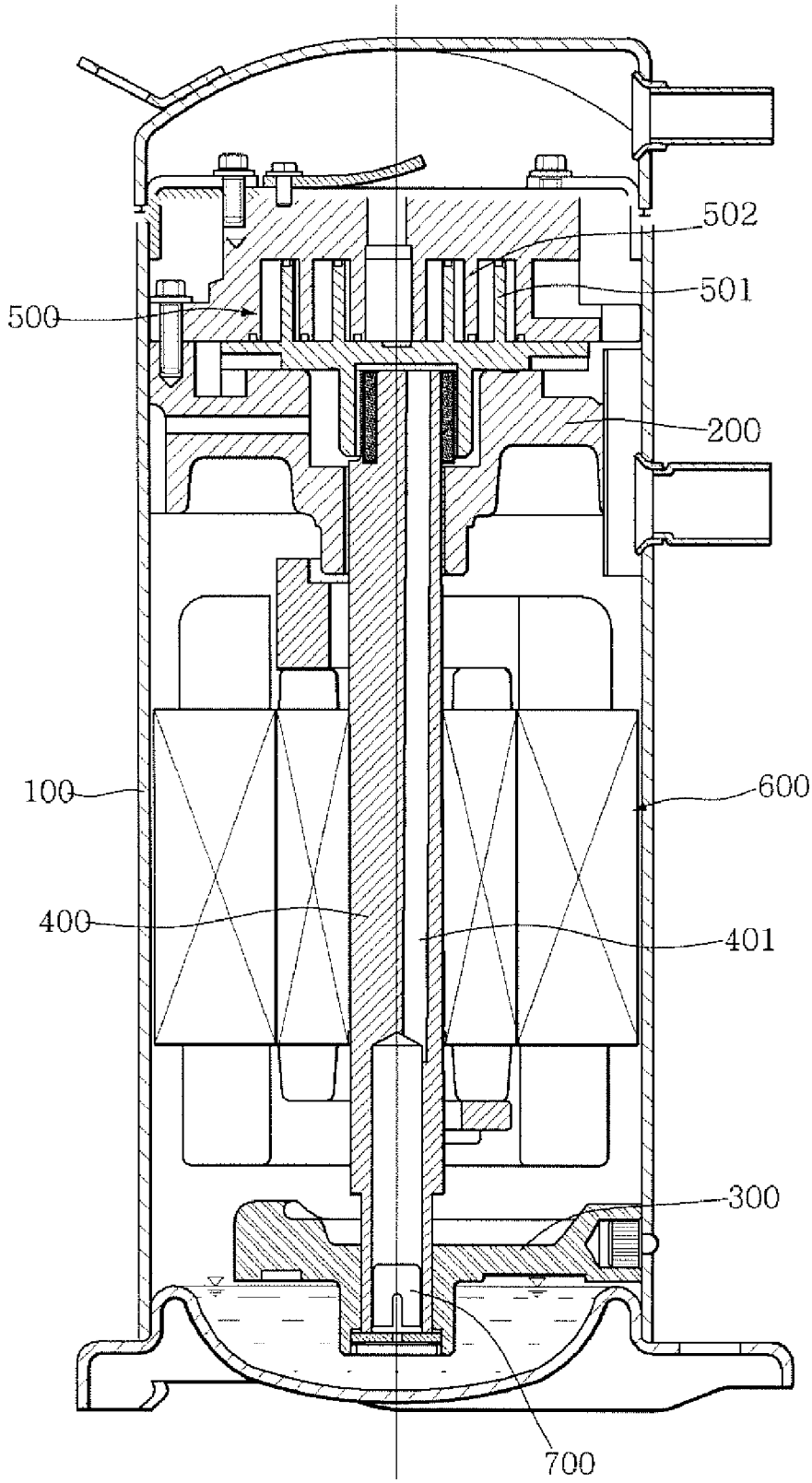
FIG.1 Related Art
FIG. 1 is a vertical sectional view illustrating a conventional scroll compressor.
Figure 2:
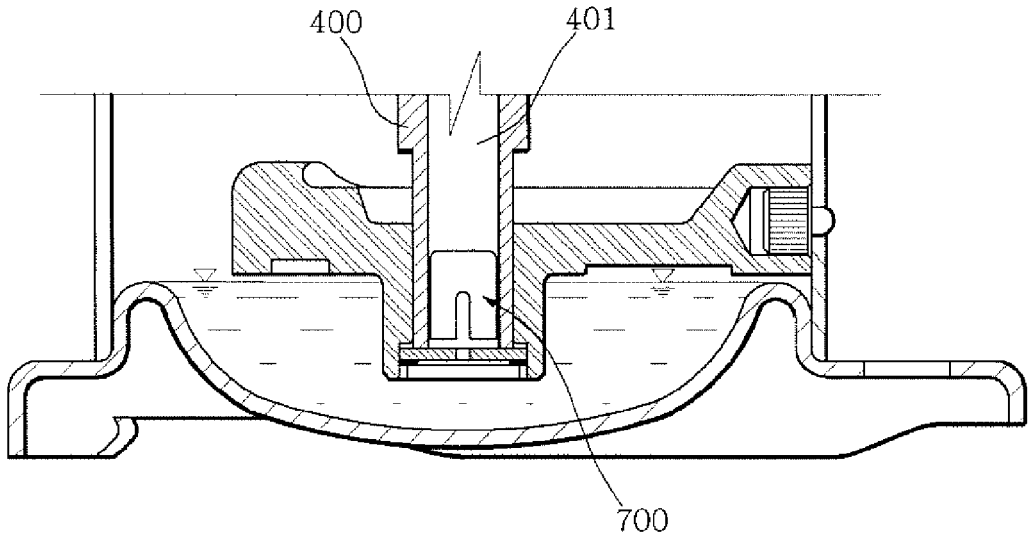
FIG.2 Related Art
FIG. 2 is an enlarged view of main parts of the convention scroll compressor in FIG. 1.
Figure 3:
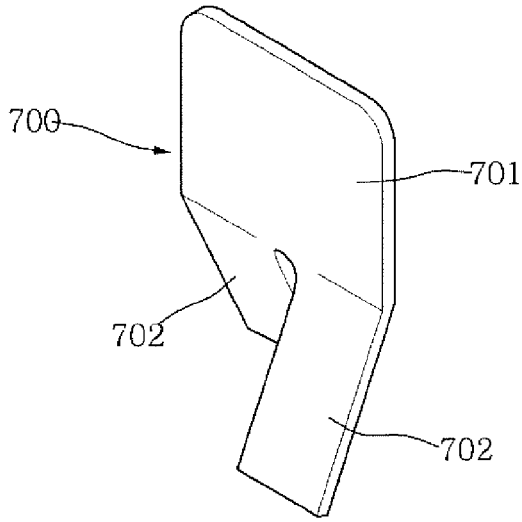
FIG.3 Related Art
FIG. 3 is a perspective sectional view illustrating the oil feeding propeller depicted in FIG. 2.
Figure 4:
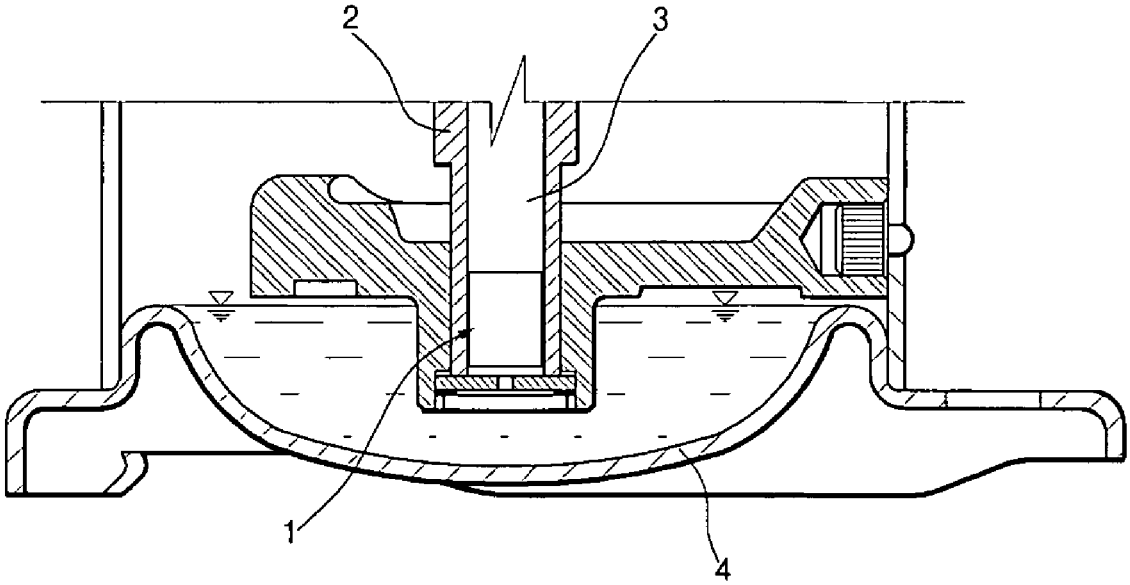
FIG. 4 is an enlarged sectional view of a scroll compressor employing an oil feeding propeller according to a first preferred embodiment of the present invention.
Figure 5:
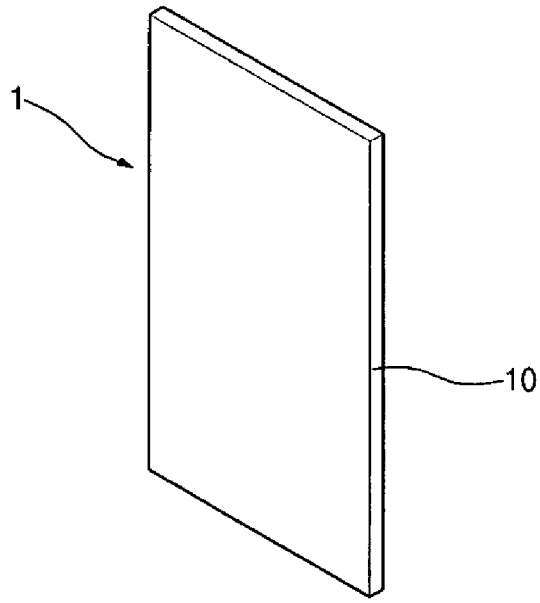
FIG. 5 is a perspective view of the oil feeding propeller of a scroll compressor according to the first preferred embodiment of the present invention.

FIG. 4 is an enlarged sectional view of a scroll compressor employing an oil feeding propeller according to a first preferred embodiment of the present invention, and FIG. 5 is a perspective view of the oil feeding propeller of a scroll compressor according to the first preferred embodiment of the present invention.

As shown in FIGS. 4 and 5, the oil feeding propeller 1 of a scroll compressor according to the first preferred embodiment of the present invention is tightly fitted into the lower side of an oil passage 3 formed in a rotation shaft 2 in the axial direction and sucks and raises oil reserved in a shell 4 to a compression part through the oil passage 3 when the rotation shaft 2 is rotated.

As such, the oil feeding propeller 1 is made of a plate without operative direction for feeding oil in a predetermined direction so that the oil feeding propeller 1 raises a predetermined quantity of oil regardless of the rotational direction of the rotation shaft 2.

The plate 10 is tightly fitted into the oil passage 3 of the rotation shaft 2 in the longitudinal direction and is installed in the oil passage 3 so that the oil feeding propeller 1 raises the predetermined oil due to the rotation of the rotation shaft 2 regardless of the rotational direction of the rotation shaft 2.

Thus, in a scroll compressor employing the oil feeding propeller according to the first preferred embodiment of the present invention, oil is smoothly fed by the oil feeding propeller 1 even when the rotation shaft 2 is rotated in reverse.

Figure 6:
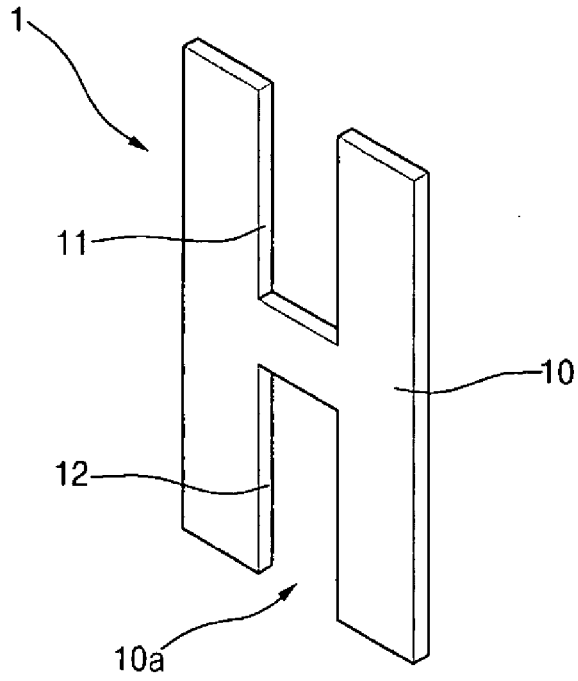
FIG. 6 is a perspective view of an oil feeding propeller of a scroll compressor according to a second preferred embodiment of the present invention.

FIG. 6 is a perspective view of an oil feeding propeller of a scroll compressor according to a second preferred embodiment of the present invention.

As shown in the drawing, the oil feeding propeller 1 of a scroll compressor includes a plate 10 without operative direction for feeding oil in a predetermined direction so as to raise a predetermined quantity of oil regardless of the rotational direction of the rotation shaft 2, and an oil reducer 10*a* for reducing flow resistance of oil contacting the plate 10 and for reducing the quantity of oil to be fed.

Further, the oil reducer 10*a* includes an upper groove 11 formed in the upper side of the plate 10 and a lower groove 12 corresponding to the upper groove 11 and formed in the lower side of the plate 10.

The plate 10 is tightly fitted into the oil passage 3 of the rotation shaft 2 in the longitudinal direction and is installed in the oil passage 3 so that the oil feeding propeller 1 raises the predetermined quantity of oil to the compression part regardless of forward rotation and reverse rotation of the rotation shaft 2 when the rotation shaft is rotated.

Moreover, the upper groove 11 and the lower groove 12 are spaces formed between lateral sides of the plate 10 and have a predetermined gap, reduce flow resistance of oil generated when the oil feeding propeller 1 is rotated at high speed, i.e. when the plate 10 is rotated at high speed, and feed a quantity of oil less than the quantity of oil fed by the plate without the upper and lower grooves 11 and 12 to the compression part.

Therefore, in a scroll compressor employing the oil feeding propeller 1 of the second preferred embodiment of the present invention, oil is smoothly fed by the oil feeding propeller 1 even when the rotation shaft 2 is reversely rotated. Moreover, when the rotation shaft is rotated at high speed, flow resistance of oil is reduced and the quantity of oil to be fed to the compression part is adjusted.

Figure 7:
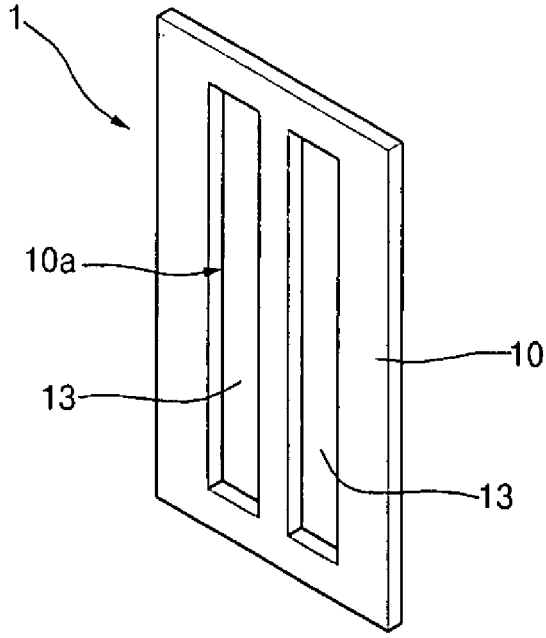
FIG. 7 is a perspective view of an oil feeding propeller of a scroll compressor according to a third preferred embodiment of the present invention.

FIG. 7 is a perspective view of an oil feeding propeller of a scroll compressor according to a third preferred embodiment of the present invention.

As shown in the drawing, the oil feeding propeller 1 of a scroll compressor includes a plate 10 without operative direction for feeding oil in a predetermined direction so as to raise a predetermined quantity of oil regardless of rotational direction of the rotation shaft 2, and an oil reducer 10*a* for reducing flow resistance of oil contacting the plate 10 and for reducing the quantity of oil to be fed.

Further, the oil reducer 10*a* has at least one longitudinal hole 13 formed in the longitudinal direction thereof The plate 10 is tightly fitted into the oil passage 3 of the rotation shaft 2 in the longitudinal direction so that the oil feeding propeller 1 raises a predetermined quantity of oil to the compression part due to the rotation of the rotation shaft 2 regardless of the forward rotation and the reverse rotation of the rotation shaft 2.

The longitudinal hole 13 of the oil reducer 10*a* is a space formed between lateral sides of the plate 10 and has a predetermined gap, reduces flow resistance of oil generated when the oil feeding propeller 1 is rotated at high speed, i.e. when the plate 10 is rotated at high speed, and feeds the quantity of oil less than quantity of oil fed by the plate without the longitudinal hole 13 to the compression part.

Therefore, in a scroll compressor employing the oil feeding propeller 1 of the third preferred embodiment of the present invention, oil is smoothly fed by the oil feeding propeller 1 even when the rotation shaft 2 is reversely rotated. Moreover, when the rotation shaft is rotated at high speed, flow resistance of oil is reduced and the quantity of oil to be fed to the compression part is adjusted.

Figure 8:
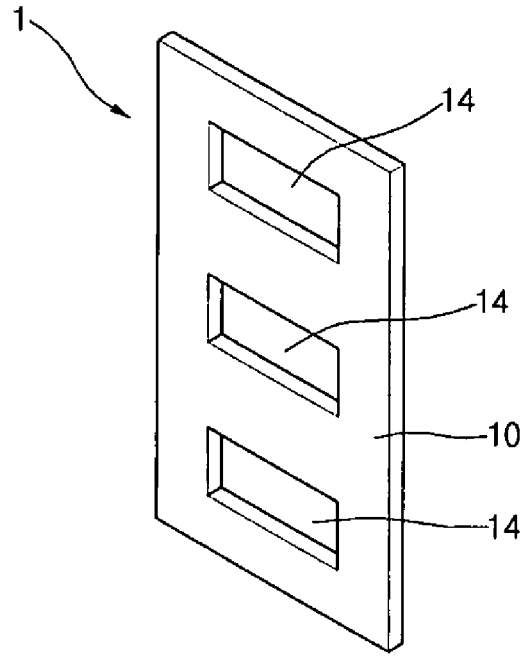
FIG. 8 is a perspective view of an oil feeding propeller of a scroll compressor according to a fourth preferred embodiment of the present invention.

FIG. 8 is a perspective view of an oil feeding propeller of a scroll compressor according to a fourth preferred embodiment of the present invention.

As shown in the drawing, the oil feeding propeller 1 of a scroll compressor includes a plate 10 without operative direction for feeding oil in a predetermined direction so as to raise a predetermined quantity of oil regardless of rotational direction of the rotation shaft 2, and an oil reducer 10*a* for reducing flow resistance of oil contacting the plate 10 and for reducing quantity of oil.

Further, the oil reducer 10*a* has at least one lateral hole 14 formed in the lateral direction.

The plate 10 is tightly fitted into the oil passage 3 of the rotation shaft 2 in the longitudinal direction so that the oil feeding propeller 1 raises a predetermined quantity of oil to the compression part due to the rotation of the rotation shaft 2 regardless of the forward rotation and the reverse rotation of the rotation shaft 2.

The lateral hole 14 of the oil reducer 10*a* is a space formed between upper and lower sides of the plate 10 and has a predetermined gap, reduces flow resistance of oil generated when the oil feeding propeller 1 is rotated at high speed, i.e. when the plate 10 is rotated at high speed, and feeds the quantity of oil less than quantity of oil fed by the plate without the lateral hole 13 to the compression part.

Therefore, in a scroll compressor employing the oil feeding propeller 1 of the fourth preferred embodiment of the present invention, oil is smoothly fed by the oil feeding propeller 1 even when the rotation shaft 2 is rotated in reverse. Moreover, when the rotation shaft is rotated at high speed, flow resistance of oil is reduced and the quantity of oil to be fed to the compression part is adjusted.

Figure 9:
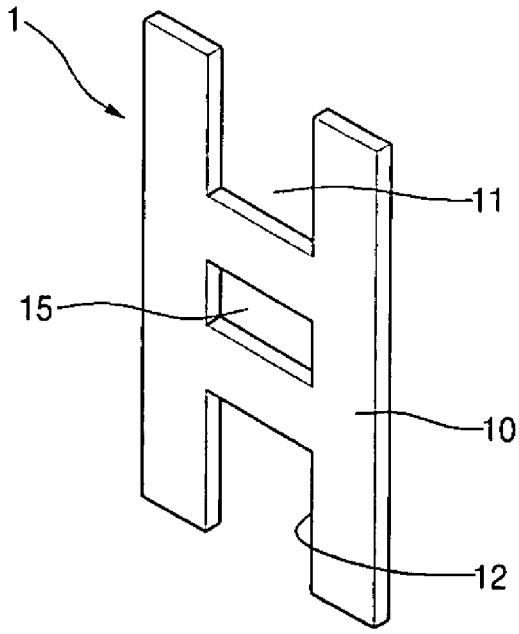
FIG. 9 is a perspective view of an oil feeding propeller of a scroll compressor according to a fifth preferred embodiment of the present invention.

FIG. 9 is a perspective view of an oil feeding propeller of a scroll compressor according to a fifth preferred embodiment of the present invention.

As shown in the drawing, the oil feeding propeller 1 of a scroll compressor includes a plate 10 without operative direction for feeding oil in a predetermined direction so as to raise a predetermined quantity of oil regardless of rotational direction of the rotation shaft 2, and an oil reducer 10*a* for reducing flow resistance of oil contacting the plate 10 and for reducing the quantity of oil to be fed.

Further, the oil reducer 10*a* has an upper groove 11 formed in the upper side of the plate 10, a lower groove 12 formed in the lower side of the plate 10 corresponding to the upper groove 11, and a center hole 15 formed between the upper groove 11 and the lower groove 12.

The plate 10 is tightly fitted into the oil passage 3 of the rotation shaft 2 in the longitudinal direction so that the oil feeding propeller 1 raises a predetermined quantity of oil to the compression part due to the rotation of the rotation shaft 2 regardless of the forward rotation and the reverse rotation of the rotation shaft 2.

The upper groove 11, the lower groove 12, and the center hole 15 of the oil reducer 10*a* are spaces formed in the plate 10 and has a predetermined gap, reduces flow resistance of oil generated when the oil feeding propeller 1 is rotated at high speed, i.e. when the plate 10 is rotated at high speed, and feed the quantity of oil less than quantity of oil fed by the plate without the upper groove 11, the lower groove 12, and the center hole 15 to the compression part.

Therefore, in a scroll compressor employing the oil feeding propeller 1 of the fifth preferred embodiment of the present invention, oil is smoothly fed by the oil feeding propeller 1 even when the rotation shaft 2 is rotated in reverse. Moreover, when the rotation shaft is rotated at high speed, flow resistance of oil is reduced and the quantity of oil fed to the compression part is adjusted.

Figure 10:
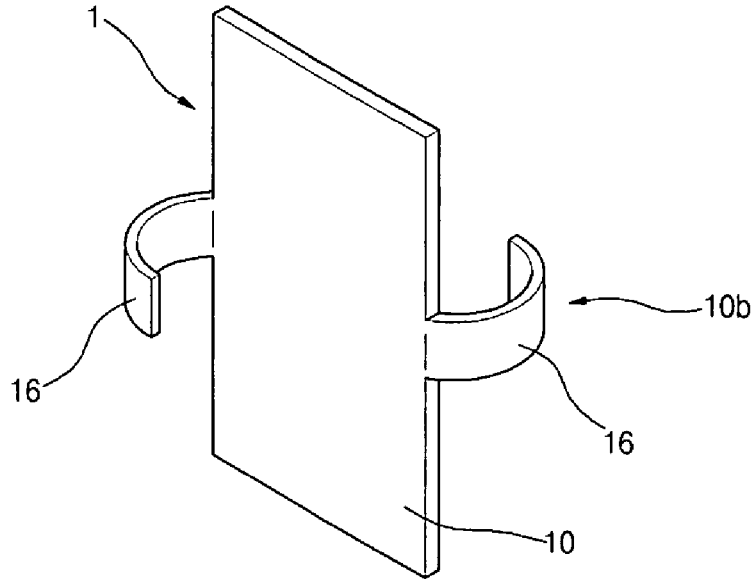
FIG. 10 is a perspective view of an oil feeding propeller of a scroll compressor according to a sixth preferred embodiment of the present invention.

FIG. 10 is a perspective view of an oil feeding propeller of a scroll compressor according to a sixth preferred embodiment of the present invention.

As shown in the drawing, the oil feeding propeller 1 of a scroll compressor includes a plate 10 without operative direction for feeding oil in a predetermined direction so as to raise a predetermined quantity of oil regardless of the rotational direction of the rotation shaft 2, and an elastic support 10*b* formed at the lateral sides of the plate 10 and elastically forcing the plate 10 into close contact with the oil passage 3.

The elastic support 10*b* has arc-shaped blades 16 formed at the lateral sides of the plate and closely contacting the inner wall of the oil passage 3. The arc-shaped blades 16 are formed symmetrically to each other such that the arc-shaped blades 16 closely contact the inner wall of the oil passage 3.

The plate 10 is tightly fitted into the oil passage 3 of the rotation shaft 2 in the longitudinal direction so that the oil feeding propeller 1 raises a predetermined quantity of oil to the compression part due to the rotation of the rotation shaft 2 regardless of the forward rotation and the reverse rotation of the rotation shaft 2.

Moreover, the arc-shaped blades 16 of the elastic support 10*b* are integrally formed with the lateral sides of the plate 10 and closely contact the inner circumference of the oil passage 3 of the rotation shaft 2, so that the plate 10 is easily installed in the oil passage 3 and easily contacts the oil passage 3.

Therefore, in a scroll compressor employing the oil feeding propeller 1 of the sixth preferred embodiment of the present invention, oil is smoothly fed by the oil feeding propeller 1 even when the rotation shaft 2 is rotated in reverse, and the plate 10 is easily installed in the oil passage 3.

Figure 11:
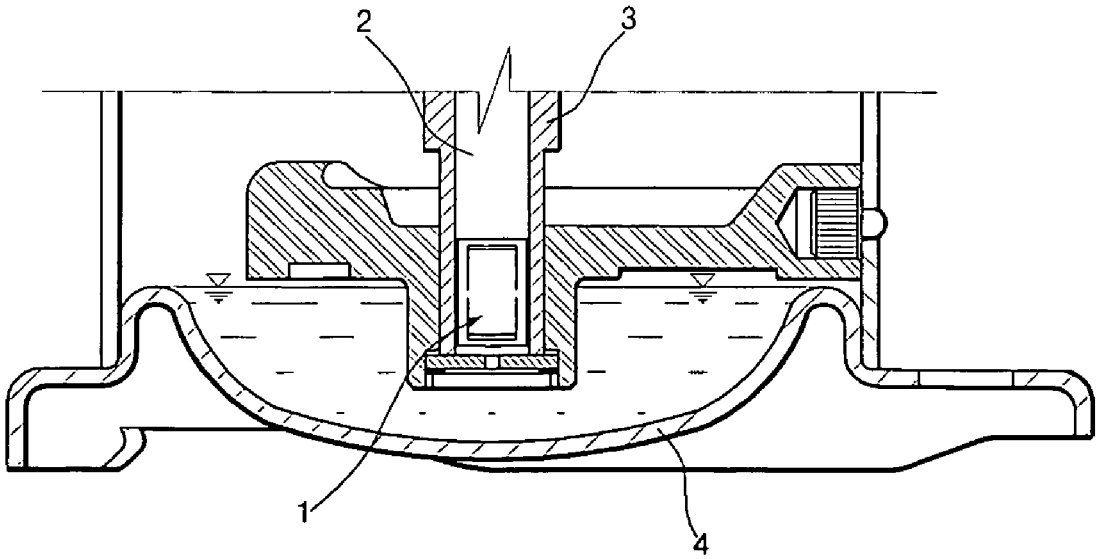
FIG. 11 is an enlarged vertical sectional view of a scroll compressor employing an oil feeding propeller according to a seventh preferred embodiment of the present invention.
Figure 12:
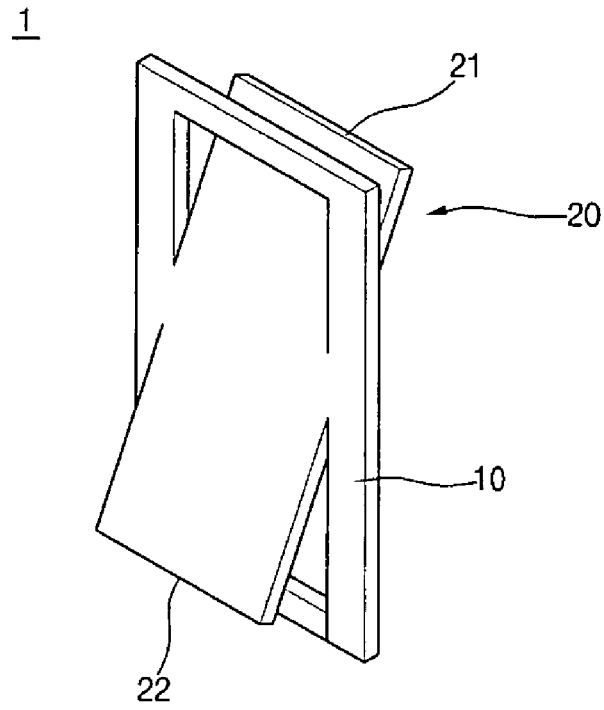
FIG. 12 is a perspective view of the oil feeding propeller of a scroll compressor according to the seventh preferred embodiment of the present invention.

FIG. 11 is an enlarged vertical sectional view of main parts of a scroll compressor employing an oil feeding propeller according to a seventh preferred embodiment of the present invention, and FIG. 12 is a perspective view of the oil feeding propeller of a scroll compressor according to the seventh preferred embodiment of the present invention.

As shown in the drawing, the oil feeding propeller 1 of a scroll compressor is tightly fitted into the lower side of the oil passage 3 formed in the rotation shaft 2 in the axial direction, sucks oil reserved in the shell 4 into the oil passage 3 due to the rotation of the rotation shaft 2, and raises the sucked oil to the compression part of the scroll compressor via the oil passage 3.

The oil feeding propeller 1 includes a plate 10 without operative direction for feeding oil in a predetermined direction so as to raise a predetermined quantity of oil regardless of the rotational direction of the rotation shaft 2, and an inclined member 20 integrally formed with the plate 10 at an angle.

The plate 10 is tightly fitted into the oil passage 3 of the rotation shaft 2 in the longitudinal direction and the inclined member 20 is formed at the plate 10 at an angle so that the oil feeding propeller 1 raises a predetermined quantity of oil to the compression part due to the rotation of the rotation shaft 2 regardless of the direction in which the rotation shaft 2 is rotated.

The inclined member 20 includes an upper inclined plate 21 cut off from the upper side of the plate 10 and upwardly inclined at an angle, and a lower inclined plate 22 cut off from the lower side of the plate 10 and downwardly inclined at the same angle as the angle of the upper inclined plate 21.

The upper inclined plate 21 and the lower inclined plate 22 are inclined to form predetermined spaces in the plate 10 while having no operative direction for feeding oil in a predetermined direction, reduce flow resistance of oil generated when the oil feeding propeller 1 is rotated at high speed, i.e. when the plate 10 is rotated at high speed, and raise a predetermined quantity of oil to the compression part.

Therefore, in a scroll compressor employing the oil feeding propeller 1 of the seventh preferred embodiment of the present invention, oil is smoothly fed by the oil is feeding propeller 1 even when the rotation shaft 2 is rotated in reverse. Moreover, when the rotation shaft is rotated at high speed, flow resistance of oil is reduced.

Figure 13:
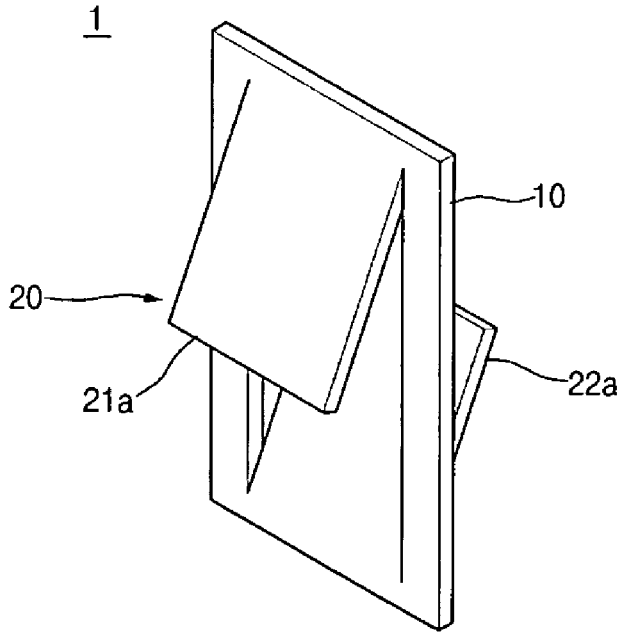
FIG. 13 is a perspective view of an oil feeding propeller of a scroll compressor according to an eighth preferred embodiment of the present invention.

FIG. 13 is a perspective view of an oil feeding propeller of a scroll compressor according to an eighth preferred embodiment of the present invention.

As shown in the drawing, the oil feeding propeller 1 of a scroll compressor includes a plate 10 without operative direction for feeding oil in a predetermined direction so as to raise a predetermined quantity of oil regardless of the rotational direction of the rotation shaft 2, and an inclined member 20 integrally formed with the plate 10 and inclined at an angle.

The plate 10 is tightly fitted into the oil passage 3 of the rotation shaft 2 in the longitudinal direction and the inclined member 20 is formed at the plate 10 at an angle so that the oil feeding propeller 1 raises a predetermined quantity of oil to the compression part due to the rotation of the rotation shaft 2 regardless of the direction in which the rotation shaft 2 is rotated.

The inclined member 20 includes an upper inclined plate 21*a*, cut off from the central portion of the plate 10, downwardly inclined at an angle, and connected to the upper side of the plate 10, and a lower inclined plate 22*a*, cut off from the central portion of the plate 10, and upwardly inclined at the same angle as the angle of the upper inclined plate 21*a* in parallel relation to the upper inclined plate 21*a*, and connected to the lower side of the plate 10.

The upper inclined plate 21*a* and the lower inclined plate 22*a* are inclined to form predetermined spaces in the plate 10 while having no operation direction for feeding oil in a predetermined direction and are connected to the upper and lower sides of the plate 10, respectively, and reduce flow resistance of oil generated when the oil feeding propeller 1 is rotated at high speed, i.e. when the plate 10 is rotated at high speed, and raise a predetermined quantity of oil to the compression part.

Therefore, in a scroll compressor employing the oil feeding propeller 1 of the eighth preferred embodiment of the present invention, oil is smoothly fed by the oil feeding propeller 1 even when the rotation shaft 2 is rotated in reverse. Moreover, when the rotation shaft is rotated at high speed, flow resistance of oil is reduced.

Figure 14:
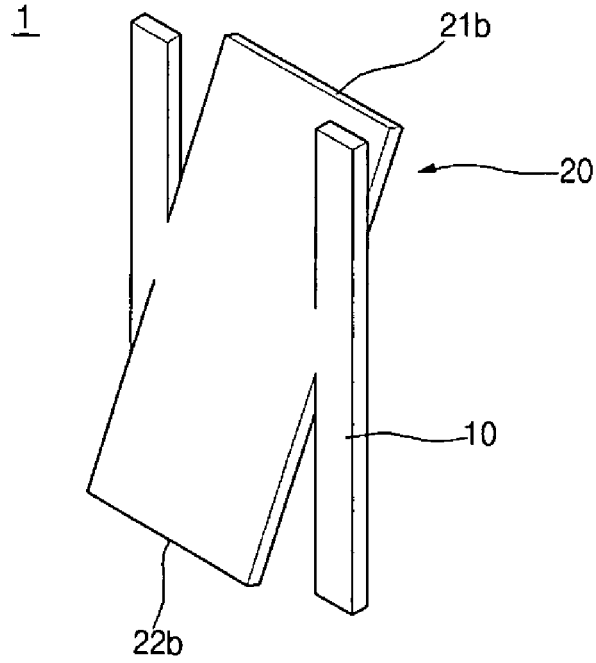
FIG. 14 is a perspective view of an oil feeding propeller of a scroll compressor according to a ninth preferred embodiment of the present invention.

FIG. 14 is a perspective view of the oil feeding propeller of a scroll compressor according to the ninth preferred embodiment of the present invention.

As shown in the drawing, the oil feeding propeller 1 of a scroll compressor includes a plate 10 without operative direction for feeding oil in a predetermined direction so as to raise a predetermined quantity of oil regardless of the rotational direction of the rotation shaft 2, and an inclined member 20 integrally formed with the plate 10 and inclined at an angle.

The plate 10 is tightly fitted into the oil passage 3 of the rotation shaft 2 in the longitudinal direction and the inclined member 20 is formed at the plate 10 at an angle so that the oil feeding propeller 1 raises a predetermined quantity of oil to the compression part due to the rotation of the rotation shaft 2 regardless of the forward rotation and the reverse rotation of the rotation shaft 2.

The inclined member 20 includes an upper inclined plate 21*b* cut off from the central upper portion of the plate 10 in the longitudinal direction and upwardly inclined at an angle, and a lower inclined plate 22*b* cut off from the central lower portion of the plate 10 in the longitudinal direction and downwardly inclined at the same angle as the angle of the upper inclined plate 21*a*.

The upper inclined plate 21*b* and the lower inclined plate 22*b* are inclined to form predetermined spaces in the plate 10 while having no operation direction for feeding oil in a predetermined direction and are connected to the upper and lower sides of the plate 10, respectively, and reduce flow resistance of oil generated when the oil feeding propeller 1 is rotated at high speed, i.e. when the plate 10 is rotated at high speed, and raise a predetermined quantity of oil to the compression part.

Therefore, in a scroll compressor employing the oil feeding propeller 1 of the ninth preferred embodiment of the present invention, oil is smoothly fed by the oil feeding propeller 1 even when the rotation shaft 2 is rotated in reverse. Moreover, when the rotation shaft is rotated at high speed, flow resistance of oil contacting the oil feeding propeller 1 is reduced.

Figure 15:
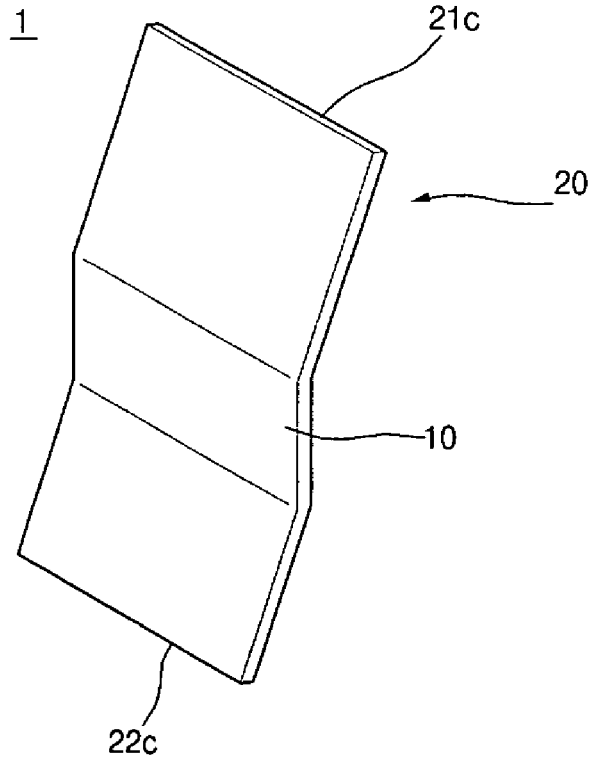
FIG. 15 is a perspective view of an oil feeding propeller of a scroll compressor according to a tenth preferred embodiment of the present invention.

FIG. 15 is a perspective view of the oil feeding propeller of a scroll compressor according to the tenth preferred embodiment of the present invention.

As shown in the drawing, the oil feeding propeller 1 of a scroll compressor includes a plate 10 without operative direction for feeding oil in a predetermined direction so as to raise a predetermined quantity of oil regardless of the rotational direction of the rotation shaft 2, and an inclined member 20 integrally formed with the plate 10 and inclined at an angle.

The plate 10 is tightly fitted into the oil passage 3 of the rotation shaft 2 in the longitudinal direction and the inclined member 20 is formed at the plate 10 at an angle so that the oil feeding propeller 1 raises a predetermined quantity of oil to the compression part due to the rotation of the rotation shaft 2 regardless of the direction in which the rotation shaft 2 is rotated.

The inclined member 20 includes an upper inclined plate 21*c* bent at the upper side of the plate 10 and upwardly inclined at an angle, and a lower inclined plate 22*c* bent at the lower side of the plate 10 in the direction opposite to the direction of the upper inclined plate 21*c* and downwardly inclined at the same angle as the angle of the upper inclined plate 21*c*.

The upper inclined plate 21*c* and the lower inclined plate 22*c* are inclined to form predetermined spaces in the plate 10 while having no operation direction for feeding oil in a predetermined direction and are connected to the upper and lower sides of the plate 10, respectively, and reduce flow resistance of oil generated when the oil feeding propeller 1 is rotated at high speed, i.e. when the plate 10 is rotated at high speed, and raise a predetermined quantity of oil to the compression part.

Therefore, in a scroll compressor employing the oil feeding propeller 1 of the tenth preferred embodiment of the present invention, oil is smoothly fed by the oil feeding propeller 1 even when the rotation shaft 2 is reversely rotated. Moreover, when the rotation shaft is rotated at high speed, flow resistance of oil contacting the oil feeding propeller 1 is reduced.

Figure 16:
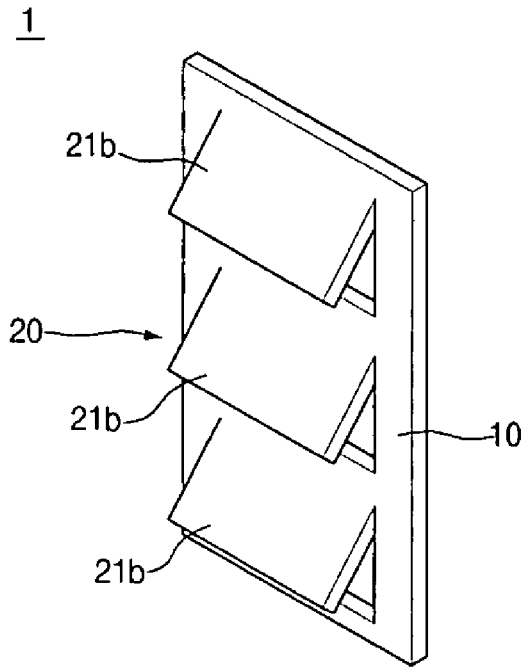
FIG. 16 is a perspective view of an oil feeding propeller of a scroll compressor according to an eleventh preferred embodiment of the present invention.

FIG. 16 is a perspective view of the oil feeding propeller of a scroll compressor according to the eleventh preferred embodiment of the present invention.

As shown in the drawing, the oil feeding propeller 1 of a scroll compressor includes a plate 10 without operative direction for feeding oil in a predetermined direction so as to raise a predetermined quantity of oil regardless of the rotational direction of the rotation shaft 2, and an inclined member 20 integrally formed with the plate 10 and inclined at an angle.

The plate 10 is tightly fitted into the oil passage 3 of the rotation shaft 2 in the longitudinal direction and the inclined member 20 is formed at the plate 10 at an angle so that the oil feeding propeller 1 raises a predetermined quantity of oil to the compression part due to the rotation of the rotation shaft 2 regardless of direction in which the rotation shaft 2 is rotated.

The inclined member 20 includes a plurality of inclined plates 21*d* cut off from the intermediate portion of the plate 10 at regular intervals and inclined at an angle.

The inclined plates 21*d* are inclined to form predetermined spaces in the plate 10 while having no operative direction for feeding oil in a predetermined direction and are connected to the upper and lower sides of the plate 10, respectively, and reduce flow resistance of oil generated when the oil feeding propeller 1 is rotated at high speed, i.e. when the plate 10 is rotated at high speed, and raise a predetermined quantity of oil to the compression part.

Therefore, in a scroll compressor employing the oil feeding propeller 1 of the eleventh preferred embodiment of the present invention, oil is smoothly fed by the oil feeding propeller 1 even when the rotation shaft 2 is rotated in reverse. Moreover, when the rotation shaft is rotated at high speed, flow resistance of oil contacting the oil feeding propeller 1 is reduced.

Figure 17:
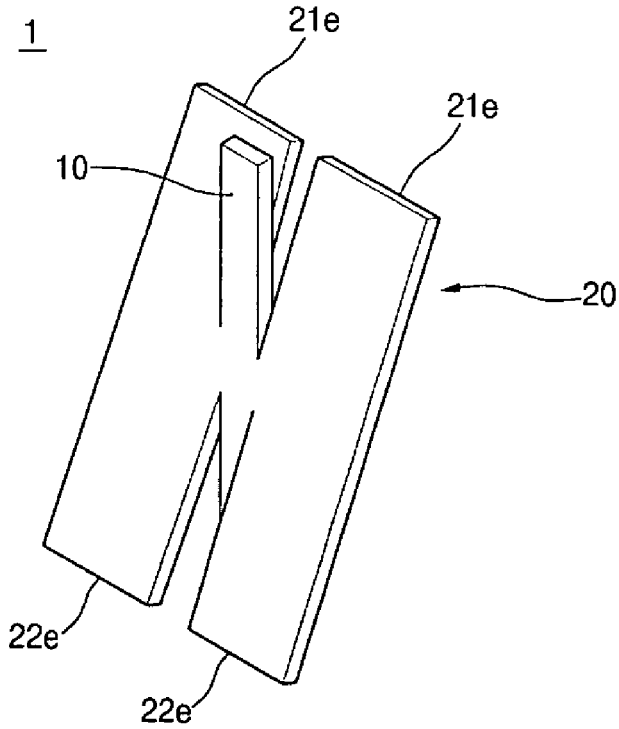
FIG. 17 is a perspective view of an oil feeding propeller of a scroll compressor according to a twelfth preferred embodiment of the present invention.

FIG. 17 is a perspective view of the oil feeding propeller of a scroll compressor according to the twelfth preferred embodiment of the present invention.

As shown in the drawing, the oil feeding propeller 1 of a scroll compressor includes a plate 10 without operative direction for feeding oil in a predetermined direction so as to raise a predetermined quantity of oil regardless of rotational direction of the rotation shaft 2, and an inclined member 20 integrally formed with the plate 10 and inclined at an angle.

The plate 10 is tightly fitted into the oil passage 3 of the rotation shaft 2 in the longitudinal direction and the inclined member 20 is formed at the plate 10 at an angle so that the oil feeding propeller 1 raises a predetermined quantity of oil to the compression part due to the rotation of the rotation shaft 2 regardless of the forward rotation and the reverse rotation of the rotation shaft 2.

The inclined member 20 includes an upper inclined plate 21*e* cut off from the upper lateral sides of the plate 10 and upwardly inclined at an angle and a lower inclined plate 22*e* cut off from the lower lateral sides of the plate 10 and inclined at an angle.

The upper and lower inclined plates 21*e* and 22*e* are inclined to form predetermined spaces in the plate 10 while having no operation direction for feeding oil in a predetermined direction and are connected to the upper and lower sides of the plate 10, respectively, and reduce flow resistance of oil generated when the oil feeding propeller 1 is rotated at high speed, i.e. when the plate 10 is rotated at high speed, and raise a predetermined quantity of oil to the compression part.

Therefore, in a scroll compressor employing the oil feeding propeller 1 of the twelfth preferred embodiment of the present invention, oil is smoothly fed by the oil feeding propeller 1 even when the rotation shaft 2 is rotated in reverse. Moreover, when the rotation shaft is rotated at high speed, flow resistance of oil contacting the oil feeding propeller 1 is reduced.

Figure 18:
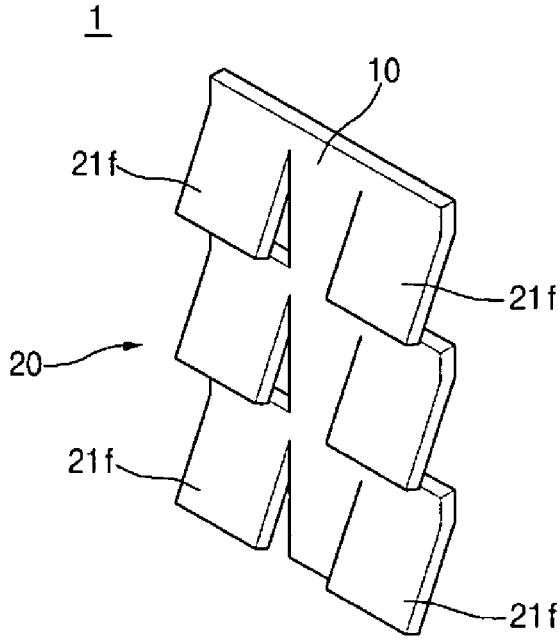
FIG. 18 is a perspective view of an oil feeding propeller of a scroll compressor according to a thirteenth preferred embodiment of the present invention.

FIG. 18 is a perspective view of the oil feeding propeller of a scroll compressor according to the thirteenth preferred embodiment of the present invention.

As shown in the drawing, the oil feeding propeller 1 of a scroll compressor includes a plate 10 without operative direction for feeding oil in a predetermined direction so as to raise a predetermined quantity of oil regardless of the rotational direction of the rotation shaft 2, and an inclined member 20 integrally formed with the plate 10 and inclined at an angle.

The plate 10 is tightly fitted into the oil passage 3 of the rotation shaft 2 in the longitudinal direction and the inclined member 20 is formed at the plate 10 at an angle so that the oil feeding propeller 1 raises a predetermined quantity of oil to the compression part due to the rotation of the rotation shaft 2 regardless of the forward rotation and the reverse rotation of the rotation shaft 2.

The inclined member 20 includes a plurality of inclined plates 21*f* cut off from several places of the lateral sides of the plate 10 in the longitudinal direction, upwardly inclined at an angle, and having upper sides thereof connected to the plate 10.

The inclined plates 21*f* are inclined to form predetermined spaces in the plate 10 while having no operative direction for feeding oil in a predetermined direction and are connected to the upper and lower sides of the plate 10, respectively, and reduce flow resistance of oil generated when the oil feeding propeller 1 is rotated at high speed, i.e. when the plate 10 is rotated at high speed, and raise a predetermined quantity of oil to the compression part.

Therefore, in a scroll compressor employing the oil feeding propeller 1 of the thirteenth preferred embodiment of the present invention, oil is smoothly fed by the oil feeding propeller 1 even when the rotation shaft 2 is reversely rotated. Moreover, when the rotation shaft is rotated at high speed, flow resistance of oil contacting the oil feeding propeller 1 is reduced.

Figure 19:
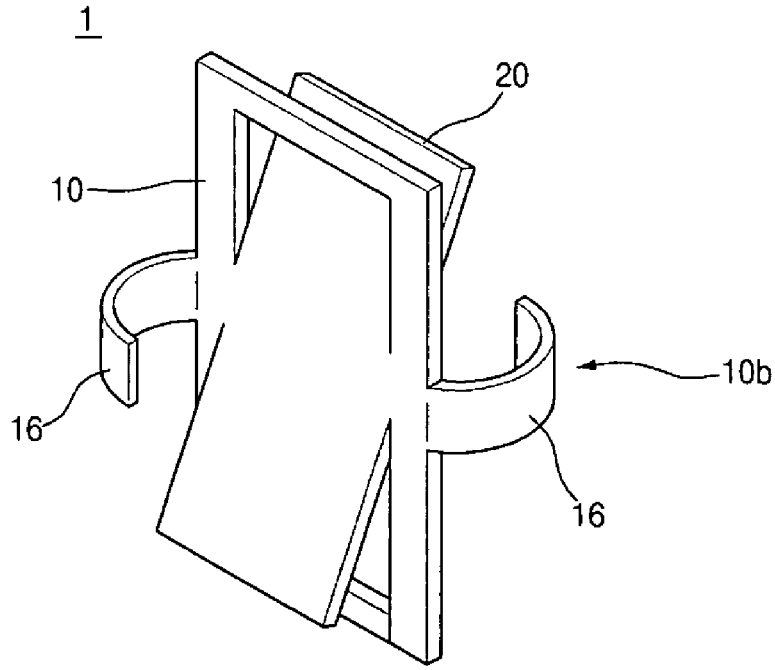
FIG. 19 is a perspective view of an oil feeding propeller of a scroll compressor according to a fifteenth preferred embodiment of the present invention.

FIG. 19 is a perspective view of the oil feeding propeller of a scroll compressor according to the fourteenth preferred embodiment of the present invention.

As shown in the drawing, the oil feeding propeller 1 of a scroll compressor includes a plate 10 without operative direction for feeding oil in a predetermined direction so as to raise a predetermined quantity of oil regardless of the rotational direction of the rotation shaft 2, an inclined member 20 integrally formed with the plate 10 and inclined at an angle, and an elastic support 10*b* formed at the lateral sides of the plate 10 and elastically closely contacting the plate 10 with the oil passage 3.

The elastic support 10*b* has arc-shaped blades 16 formed at the lateral sides of the plate and closely contacting the inner wall of the oil passage 3. The arc-shaped blades 16 are symmetrically formed to each other such that the arc-shaped blades 16 closely contact the inner wall of the oil passage 3.

The plate 10 is tightly fitted into the oil passage 3 of the rotation shaft 2 in the longitudinal direction and the inclined member 20 is formed at the plate 10 at an angle so that the oil feeding propeller 1 raises a predetermined quantity of oil to the compression part due to the rotation of the rotation shaft 2 regardless of the forward rotation and the reverse rotation of the rotation shaft 2.

Moreover, the arc-shaped blades 16 of the elastic support 10*b* are integrally formed with the lateral sides of the plate 10 and closely contact the inner circumference of the oil passage 3 of the rotation shaft 2, so that the plate 10 is easily installed in the oil passage 3 and easily contacts the oil passage 3.

Therefore, in a scroll compressor employing the oil feeding propeller 1 of the fourteenth preferred embodiment of the present invention, oil is smoothly fed by the oil feeding propeller 1 even when the rotation shaft 2 is rotated in reverse, and the plate 10 is easily installed in the oil passage 3 and closely contacts the oil passage 3.

As described above, the oil feeding propeller of a scroll compressor according to the present invention prevents deterioration of oil feeding generated when the rotation shaft is rotated in reverse so that the scroll compressor can be prevented from being damaged due to deterioration of oil feeding when the rotation shaft is rotated in reverse and reliability of the scroll compressor is enhanced.

Moreover, the oil feeding propeller of a scroll compressor according to the present invention reduces flow resistance of oil generated when the oil feeding propeller is rotated at high speed and adjusts the quantity of oil to be fed so that operational stability of the scroll compressor employing the oil feeding propeller according to the present invention and a predetermined quantity of oil is fed to the compression part of the scroll compressor.

Further, the oil feeding propeller of a scroll compressor according to the present invention reduces flow resistance of oil and raises oil to the compression part of the scroll compressor so that oil is easily fed to the compression part regardless of rotational direction of the rotation shaft of the scroll compressor.

Although the preferred embodiment of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An oil feeding propeller of a scroll compressor comprising:

an oil passage formed in a rotation shaft of the scroll compressor in the axial direction;

a plate tightly fitted in the lower side of the oil passage in the longitudinal direction, which raises oil to the upper side of the rotation shaft; and an inclined member integrally formed with the plate at an angle to reduce flow resistance of oil contacting the plate and to raise oil to a compression part, wherein the inclined member comprises:

an upper inclined plate cut off from the upper side of the plate and upwardly inclined at an angle; and a lower inclined plate cut off from the lower side of the plate and downwardly inclined at the same angle as the angle of the upper inclined plate.

2. The oil feeding propeller of a scroll compressor as set forth in claim 1, further comprising an elastic support formed at the lateral sides of the plate and elastically forcing the plate into close contact with the oil passage.

3. The oil feeding propeller of a scroll compressor as set forth in claim 2, wherein elastic support comprises arc-shaped blades formed at the lateral sides of the plate and closely contacting the inner wall of the oil passage.

4. The oil feeding propeller of a scroll compressor as set forth in claim 3, wherein the arc-shaped blades are symmetrically formed to each other such that the arc-shaped blades closely contact the inner wall of the oil passage.

5. An oil feeding propeller of a scroll compressor comprising:

an oil passage formed in a rotation shaft of the scroll compressor in the axial direction;

a plate tightly fitted in the lower side of the oil passage in the longitudinal direction, which raises oil to the upper side of the rotation shaft; and an inclined member integrally formed with the plate at an angle to reduce flow resistance of oil contacting the plate and to raise oil to a compression part, wherein the inclined member comprises:

an upper inclined plate, cut off from the central portion of the plate, downwardly inclined at an angle, and connected to the upper side of the plate; and a lower inclined plate, cut off from the central portion of the plate, and upwardly inclined at the same angle as the angle of the upper inclined plate in parallel relation to the upper inclined plate, and connected to the lower side of the plate.

6. An oil feeding propeller of a scroll compressor comprising:

an oil passage formed in a rotation shaft of the scroll compressor in the axial direction;

a plate tightly fitted in the lower side of the oil passage in the longitudinal direction, which raises oil to the upper side of the rotation shaft; and an inclined member integrally formed with the plate at an angle to reduce flow resistance of oil contacting the plate and to raise oil to a compression part, wherein the inclined member comprises:

an upper inclined plate cut off from the central upper portion of the plate in the longitudinal direction and upwardly inclined at an angle; and a lower inclined plate cut off from the central lower portion of the plate in the longitudinal direction and downwardly inclined at the same angle as the angle of the upper inclined plate.

7. An oil feeding propeller of a scroll compressor comprising:

an oil passage formed in a rotation shaft of the scroll compressor in the axial direction;

a plate tightly fitted in the lower side of the oil passage in the longitudinal direction, which raises oil to the upper side of the rotation shaft; and an inclined member integrally formed with the plate at an angle to reduce flow resistance of oil contacting the plate and to raise oil to a compression part, wherein the inclined member comprises:

an upper inclined plate bent at the upper side of the plate and upwardly inclined at an angle; and a lower inclined plate bent at the lower side of the plate in the direction opposite to the direction of the upper inclined plate and downwardly inclined at the same angle as the angle of the upper inclined plate.

8. An oil feeding propeller of a scroll compressor comprising:

an oil passage formed in a rotation shaft of the scroll compressor in the axial direction;

a plate tightly fitted in the lower side of the oil passage in the longitudinal direction, which raises oil to the upper side of the rotation shaft; and an inclined member integrally formed with the plate at an angle to reduce flow resistance of oil contacting the plate and to raise oil to a compression part, wherein the inclined member comprises:

an upper inclined plate cut off from the upper lateral sides of the plate and upwardly inclined at an angle; and a lower inclined plate cut off from the lower lateral sides of the plate and inclined at an angle.

9. An oil feeding propeller of a scroll compressor comprising:

an oil passage formed in a rotation shaft of the scroll compressor in the axial direction;

a plate tightly fitted in the lower side of the oil passage in the longitudinal direction, which raises oil to the upper side of the rotation shaft; and an inclined member integrally formed with the plate at an angle to reduce flow resistance of oil contacting the plate and to raise oil to a compression part, wherein the inclined member comprises:

a plurality of inclined plates cut of from several places of the lateral sides of the plate in the longitudinal direction, upwardly inclined at an angle, and having upper sides thereof connected to the plate.

* * * * *